US008123435B1

(12) United States Patent
DeShaw et al.

(10) Patent No.: US 8,123,435 B1
(45) Date of Patent: Feb. 28, 2012

(54) INTERLOCKING REVETMENT BLOCK WITH ARRAY OF VEGETATION HOLES

(75) Inventors: James R. DeShaw, Huntsville, TX (US); Lee A. Smith, Houston, TX (US)

(73) Assignee: Erosion Prevention Products, LLC, Houston, TX (US)

( * ) Notice: Subject to any disclaimer, the term of this patent is extended or adjusted under 35 U.S.C. 154(b) by 336 days.

(21) Appl. No.: 12/322,450

(22) Filed: Feb. 3, 2009

(51) Int. Cl.
*E02B 3/12* (2006.01)

(52) U.S. Cl. ..... 405/16; 405/15; 405/17; 405/284; 405/302.4; 52/604; 52/606

(58) Field of Classification Search ..... 405/15–17, 405/262, 282, 284, 302.4, 302.6; 52/604, 52/606, 591.3, 592.2, 585.1; 47/31.1, 33
See application file for complete search history.

(56) References Cited

U.S. PATENT DOCUMENTS 1,319,113 A * 10/1919 Reagan ..... 52/503
2,493,547 A * 1/1950 Paolella et al. ..... 52/605
3,347,048 A 10/1967 Brown et al.
3,466,986 A 9/1969 Biller
4,465,398 A 8/1984 Knudsen
4,875,803 A 10/1989 Scales
5,020,938 A 6/1991 Scales
5,429,451 A 7/1995 Pettee, Jr.
5,556,228 A 9/1996 Smith
5,921,710 A 7/1999 Scales
D415,576 S 10/1999 Scales
6,276,870 B1 8/2001 Smith
6,508,607 B1 1/2003 Smith
6,866,446 B2 3/2005 McAllister et al.
6,955,500 B1 10/2005 Smith
7,037,037 B1 5/2006 Smith et al.
7,160,052 B2 1/2007 Weiss, Jr. et al.
2005/0178081 A1 * 8/2005 Bott ..... 52/596

OTHER PUBLICATIONS

Donald A. Parsons, et al., Cellular Concrete Block Revetment, Journal of the Waterways and Harbors Division, May 1965.
Hydropave, Loves Park Creek—Conlock II, On-Line Printout, Feb. 1999.

* cited by examiner

*Primary Examiner* — John Kreck
*Assistant Examiner* — Sean Andrish
(74) *Attorney, Agent, or Firm* — Roger N. Chauza, PC

(57) ABSTRACT

A concrete revetment block having interlocking arms and sockets and an array of vegetation holes. Two arms and two sockets are formed in the block to provide interlocking capabilities with neighbor blocks of a mat. One arm of the block is constructed with a partial thickness and one socket is constructed with a partial depth, thereby providing vertical interlocking capabilities with the neighbor blocks. An array of holes is formed through the block to allow vegetation to grow therethrough. Various holes are located in the block to allow easy grasping of the block by a workman for lifting the same. The holes are formed in the core square of the block, with respective diameters related to the thickness of the block to maximize the hydraulic stability of the block.

12 Claims, 4 Drawing Sheets

INTERLOCKING REVETMENT BLOCK WITH ARRAY OF VEGETATION HOLES

TECHNICAL FIELD OF THE INVENTION

The present invention relates in general to erosion control blocks, and more particularly to erosion control blocks with holes therein adapted for anchoring by vegetation growth therethrough.

BACKGROUND OF THE INVENTION

The erosion of soil on the earth continues to occur as rain and flood waters run from high elevations to lower elevations. Many efforts have been made to reduce the erosion of soil by interrupting the runoff of water, or at least slow down the water flow and thereby reduce the extent of erosion. Erosion control blocks are available for covering watershed areas to protect the underlying soil from being carried with the runoff water. Many styles, shapes and sizes of erosion control blocks are available for placement together to form a mat that covers the ground to be protected from erosion. The use of erosion control blocks is preferred over the use of a slab of concrete, as concrete can crack and settle if the underlying ground is unstable, which it is in many watershed areas. It is also difficult to make a concrete slab that is adapted to slow down the velocity of water that flows thereover. Erosion control blocks of the articulating type continue to conform to the contour of the ground, even when the ground contour changes.

Blocks that are simply placed side by side on the ground are helpful in reducing soil erosion, but only in situations where the velocity of the runoff water is low or moderate. Otherwise, the hydraulic lift of the flowing water can cause the blocks to actually lift off the ground and be carried or otherwise moved so that the erosion protection is compromised. Of course, the heavier the block the less likely it is to be moved by high velocity water currents. This solution is costly and often prevents the installation of the heavy blocks by persons who must lift each block and place it into position with others to form the mat.

More recently, erosion control blocks have been constructed so as to be laterally interlocking so that horizontal movement is prevented. U.S. Pat. No. 5,556,228 by Smith is an example of a commercially accepted interlocking erosion control block that articulates to conform to the contour of the ground. Such type of block has been accepted by governmental organizations for use on large waterways to halt erosion of the same.

In order to further enhance the stability of a revetment block or erosion control block, holes can be formed through the body of the block so that vegetation can grow therethrough and anchor the block to the underlying ground. The use of vegetation to anchor the block or mat of blocks to the ground is advantageous in situations where the mat of blocks is not constantly covered by a substantial depth of water, as vegetation does not grow well under such conditions. Rather, there are many water shed areas where the mat of blocks covers areas that are not under water, but are subjected to substantial water flows during rains and the like. Water ways and other watershed areas comprise such situations, which may be generally dry, but which can carry heavy flows of fast moving water during storms and flood conditions. The interlocking nature of the erosion control blocks together with the anchoring of the same to the ground by vegetation allows the erosion of the underlying ground to be controlled.

While the vegetation holes in erosion control blocks allows anchoring thereof by vegetation, such holes can also present a disadvantage. For example, if vegetation does not fully occupy the opening in the block, or if there is no vegetation at all, then the hole in the block can function as a small barrier to the flow of water over the block, and impart a hydraulic lifting force on the block. In other words, the water flowing over the block applies a force to the downstream side of the hole. The resulting water turbulence and the hydraulic forces can impart a force on the block that tends to lift the upstream portion of the block. If the upstream side of the block starts to lift and becomes separated from the ground, then the lifting forces avalanche and can be sufficient to completely lift the entire block from the mat. If this occurs, then the surrounding blocks are more easily dislodged from the mat, whereupon the integrity of the entire mat of blocks can be compromised. If the mat of blocks is installed on a slope that is to be protected from erosion, such as a flume, then the velocity of the water is accelerated due to the downhill grade. With an increased velocity of a large volume of water, the integrity of the mat of blocks must be maintained.

Often the erosion control blocks are installed by workmen who can carry one block with a hand, from a skid of blocks to the location where the mat is to be formed. To that end, the blocks must be of a weight that allows an average workman to conveniently carry a block, and the block must be constructed to allow easy gripping of the same with one hand. An average four-inch thick concrete block of the type described above in U.S. Pat. No. 5,556,228 can weigh about 56 pounds, and can be carried with one hand a distance sufficient to install the same in a watershed area. An eight-inch block of the same configuration can weigh about 115 pounds, and can also be carried by a workman with two hands from a skid to the site of installment. Because of the weight, workers generally grasp the arms of the block using two hands. If the blocks are too heavy, they must be carried by wheeled carts or otherwise in order to transport them at the work site.

Facilities exist for testing the hydraulic stability of erosion control blocks in order to enable the manufacturer to certify that the blocks can remain stable under specified water flow conditions. Often such certifications are necessary in order for block suppliers and manufacturers to be granted contracts for erosion control projects. These facilities can place the test blocks under actual working conditions in a laboratory setting, where the grade, water depth, volume and velocity can be accurately controlled. As an alternative, blocks can be made physically very large and heavy to assure that they will not be moved under the severest water flow conditions. Such overkill renders the blocks unnecessarily large, heavy and difficult to install. However, once the hydraulic stability characteristics of a block are understood, they can be used in engineering the design of an efficient block that conforms to specified constraints, is easy to handle and install and is cost effective.

From the foregoing, it can be seen that a need exists for an interlocking erosion control block that employs an efficient system of vegetation holes therein. Another need exists for an erosion control blocks which employs vegetation holes therein at locations that allow easy grasping of the same by a workman. Yet another need exists for an interlocking erosion control block having plural vegetation holes placed at locations to afford sufficient area for vegetation growth, to allow easy grasping of the block, but not at locations that would affect the structural integrity of the block.

SUMMARY OF THE INVENTION

Disclosed is an erosion control block that provides interlocking capabilities with neighbor blocks of a mat. According to a feature of the invention, plural holes are formed through the block, from the top surface to the bottom surface to provide vegetation growth, as well as relief of hydrostatic pressure. The holes are constructed with diameters related to the thickness of the block to maximize the hydraulic stability thereof.

According to another feature of the invention, the holes are located in the block to also allow a workman to grasp the block using the holes to lift the same. However, the placement of the holes does not compromise the structural integrity of the block.

With regard to yet another feature of the invention, the holes are formed in a core square of the block, where the square excludes the arm and socket structures. In a preferred embodiment, five holes are formed in the core square, with two of the holes having a larger diameter than the other holes to allow three fingers of a person's hand to be inserted therein.

Another advantage of the use of multiple holes, is that each hole is tapered to flare out at the bottom of the block to enlarge the open area to the ground to allow a greater degree of vegetation to grow through the block. The tapered holes also facilitate the grasping of the block by a workman.

The block can be fabricated with cable channels therethrough, with one diagonal cable channel intersecting plural holes, and the other diagonal cable channel not intersecting any of the holes formed through the block.

According to one embodiment, disclosed is a revetment block that includes a body with a thickness defined by a distance between a top surface and a bottom surface of the body of the block, where the block has a plurality of side edges. Further included are at least two arms, where each arm extends from a respective side edge of the body of the block, and each arm has an enlarged end connected to a respective side edge by a narrowed neck portion. Included also are at least two sockets formed inwardly from respective side edges of the body of the block, where each socket has an enlarged cavity connected by a narrowed inlet to the respective side edge of the body of the block. The sockets are adapted for receiving therein an arm of a similarly constructed neighbor block. A plurality of holes are formed through the body of the block. The holes are formed in a core square of the block, where the core square includes a square area that excludes the arms and the sockets.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
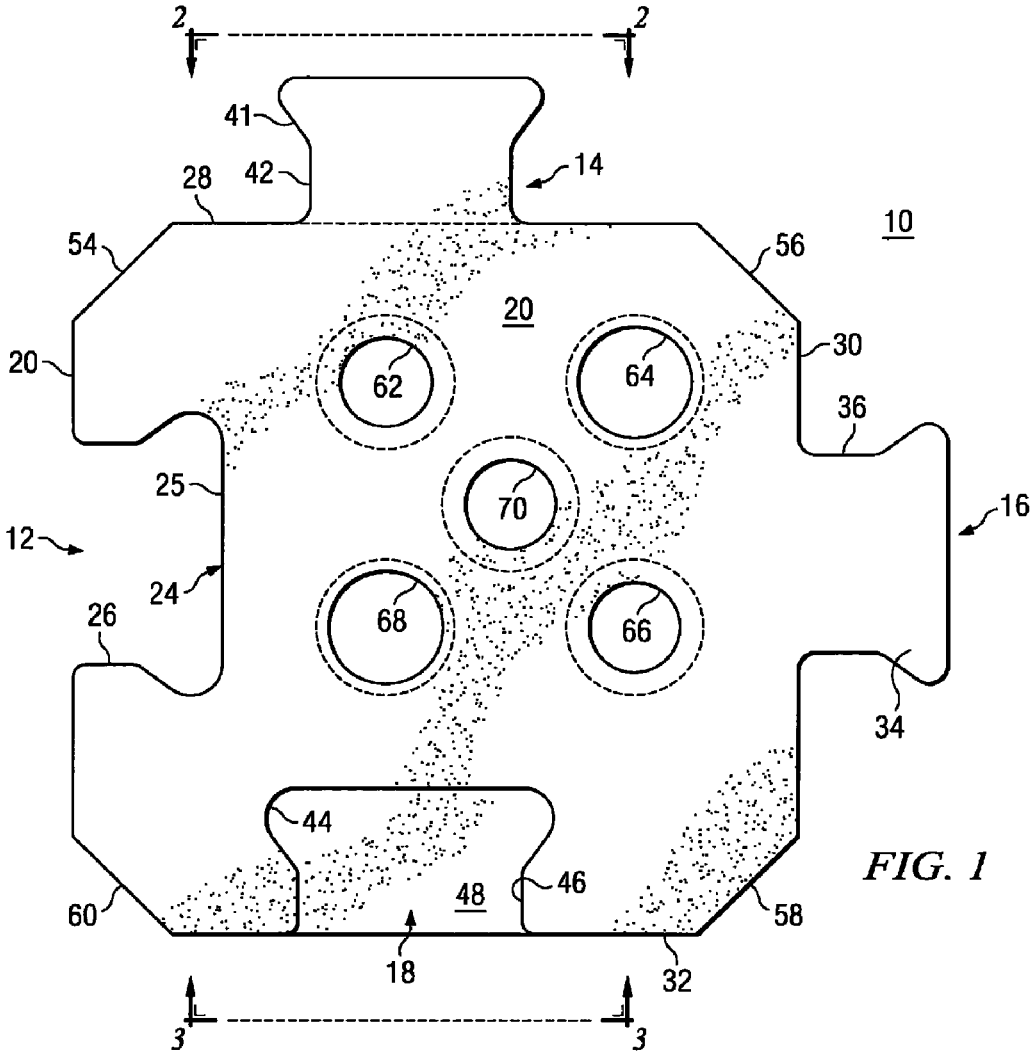
FIG. 1 is a top view of an erosion control block with an arrangement of vegetation holes therein according to the invention.
Figure 6:
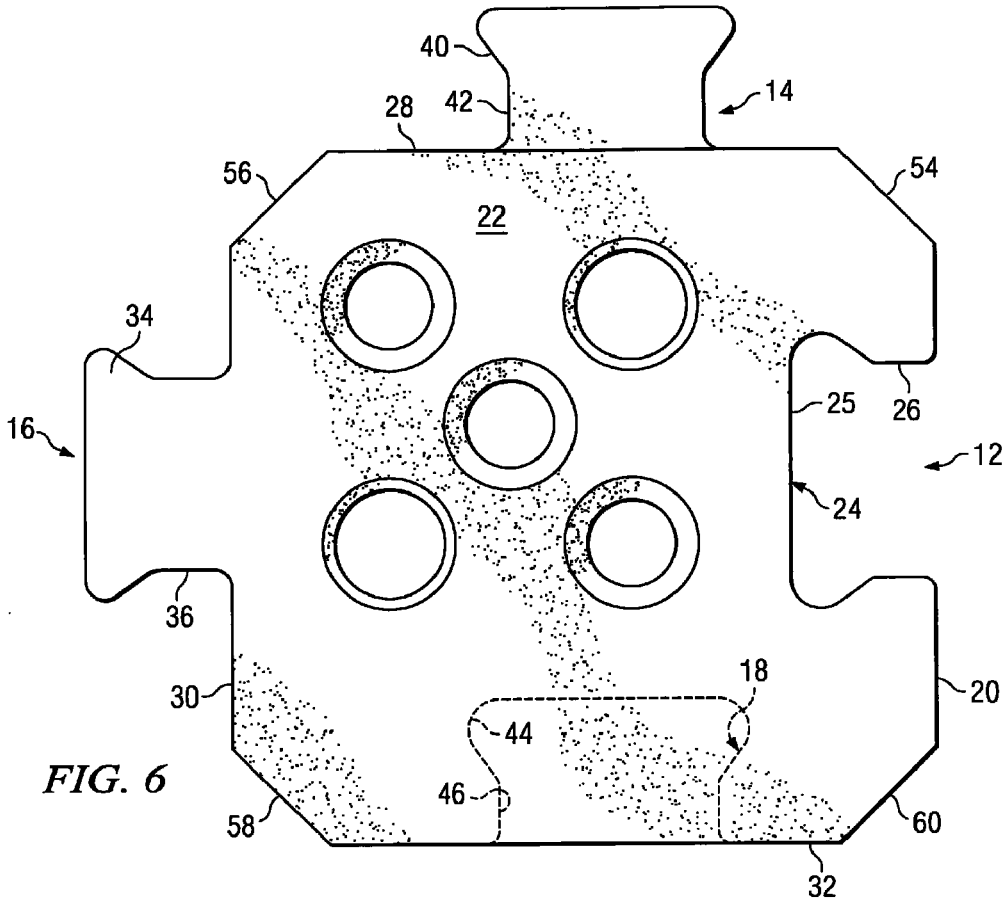
FIG. 6 is a bottom view of the revetment block of FIG. 1.

An erosion control block 10 constructed according to the invention is shown in FIG. 1. The block 10 includes a full depth socket 12, a partial thickness arm 14, a full thickness arm 16 and a partial depth socket 18. The full depth socket 12 is formed axially into a side edge 20 of the block 10, and extends from a top surface 20 of the block 10 to a bottom surface 22, shown in FIG. 6. The full depth socket 12 includes an enlarged cavity 24 connected to the edge 20 of the block 10 by a narrowed inlet 26. The full depth socket 12 includes an inner edge 25. The full depth socket 12 is the same general shape as the full thickness arm 16, but somewhat larger in size so that a full thickness arm of a similarly-constructed neighbor block can be fitted into the full depth socket 12 of the block 10. The arms 14 and 16 are formed orthogonal to each other on respective adjacent side edges 28 and 30 of the block 10. Similarly, the sockets 12 and 18 are formed orthogonal to each other into respective adjacent side edges 20 and 32 of the block 10.

In the preferred embodiment, the full thickness arm 16 is formed radially outwardly from an edge 30 of the block 10. The full thickness arm 16 includes an enlarged end 34 connected to the edge 30 by a thinned neck 36. The full thickness arm 16 extends from the top surface 20 of the block 10 to the bottom surface 22 of the block 10. The full thickness arm 16 is constructed with a shape and size to fit within a full thickness socket of a similarly-constructed neighbor block. Preferably, the full thickness arm 16 is formed on the block 10 on side edge opposite that of the full depth socket 12. The arms and sockets are shaped and sized to allow a sufficient degree of articulation between neighbor blocks.

The erosion control block 10 is constructed using mold techniques where a wet concrete mixture is poured into a mold and allowed to set. Then, the block 10 is removed from the mold. To that end, the side edges 20, 28, 30 and 32 can each include a slight taper or draft. In addition, all of the arms and sockets can also be formed with a slight draft so that the block can be removed from the mold. The block 10 can be molded with different thicknesses and dimensions noted herein. The block constructed to a preferred embodiment is about 4.5 inches thick.

Figure 2:
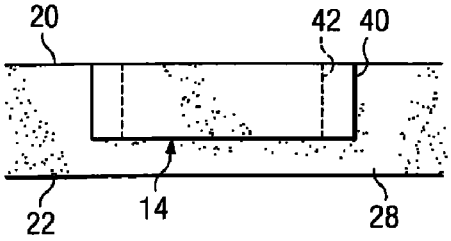
FIG. 2 is a partial side view of the modified arm of the block of FIG. 1, taken along line 2-2 thereof.
Figure 4:
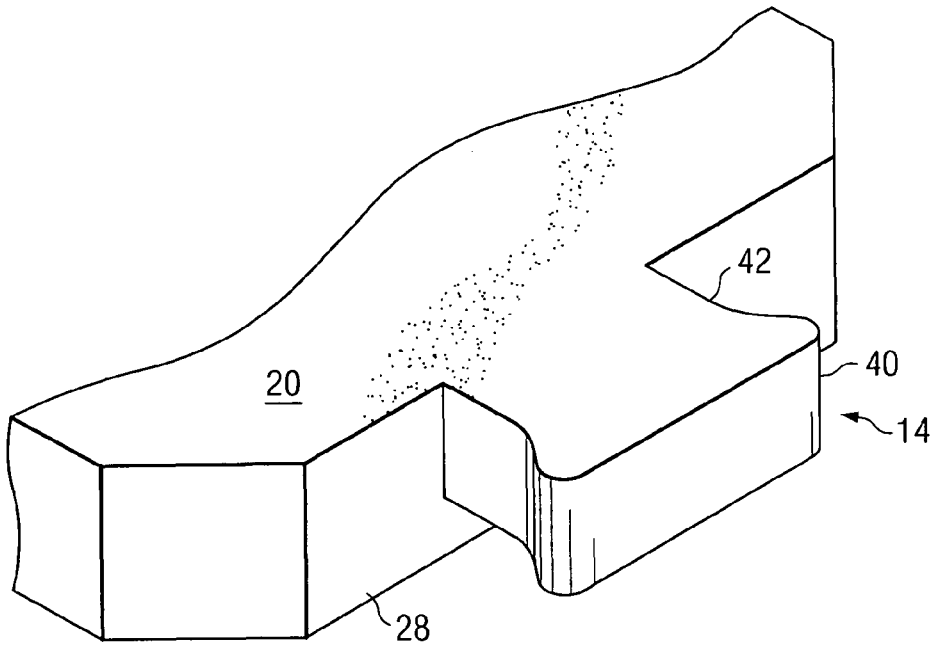
FIG. 4 is an isometric view of a portion of the interlocking revetment block of FIG. 1, illustrating the modified arm constructed according to an embodiment of the invention.

The block 10 constructed according to the invention also includes a partial thickness arm 14 that extends from the side edge 28 of the block 10. The partial thickness arm 14 includes an enlarged end 40 connected to the side edge 28 by a thinned neck 42. The details of the partial thickness arm 14 are also illustrated in FIGS. 2 and 4. The partial thickness arm 14 extends to the top surface 20 of the block 10, but is not coplanar with the bottom surface 22 of the block 10. To that end, the partial thickness arm 14 is only about 3.25 inches thick, and thus is recessed about 1.25 inches from the bottom surface 22 of the block 10. Other than the thickness, the size and shape of the partial thickness arm 14 is the same as that of the full thickness arm 16.

Figure 3:
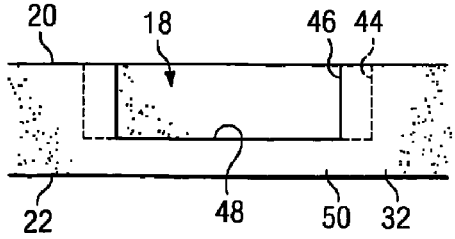
FIG. 3 is a side view of the modified socket the block of FIG. 1, taken along line 3-3 thereof.
Figure 5:
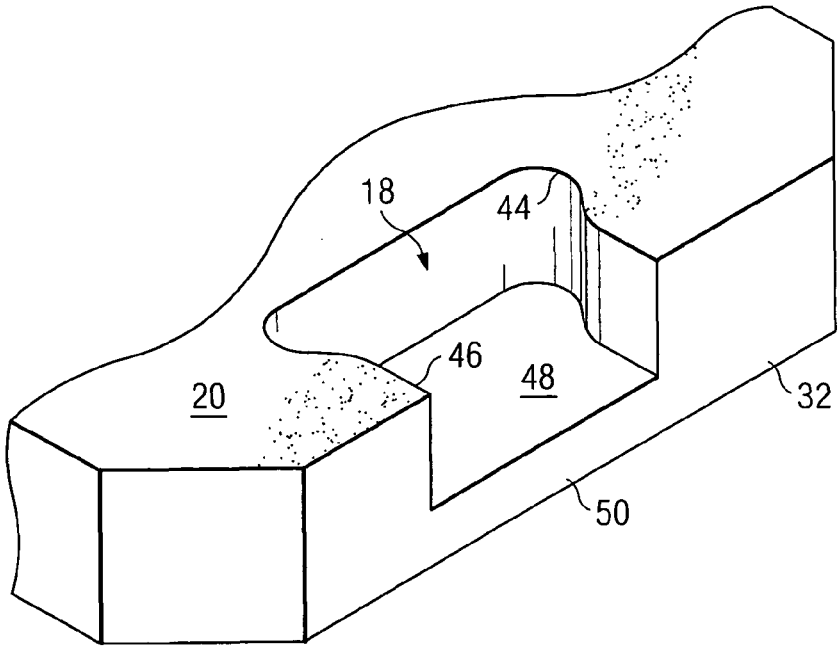
FIG. 5 is an isometric view of a portion of the interlocking revetment block of FIG. 1, illustrating the modified socket constructed according to an embodiment of the invention.

Formed in an edge 32 of the block 10 opposite the side edge 28, is a partial depth socket 18. The partial depth socket 18 includes an enlarged cavity 44 connected to the side edge 32 of the block 10 by a narrowed inlet 46. Rather than being formed completely through the block 10, the partial depth socket 18 is formed from the top surface 20 down into the body of the block about 3.25 inches. This aspect is shown in FIGS. 3 and 5. The bottom surface 48 of the partial depth socket 18 is thus about 3.25 inches from the top surface 20 of the block 10. The portion 50 of the body of the block under the partial depth socket 18 functions to strengthen the block 10, and especially that portion of the body of the block 10 that extends to the adjacent full depth socket 12. As can be seen, the partial thickness arm 14 of FIG. 4 is adapted to fit into a partial depth socket 18 of a neighbor block.

Figure 7:
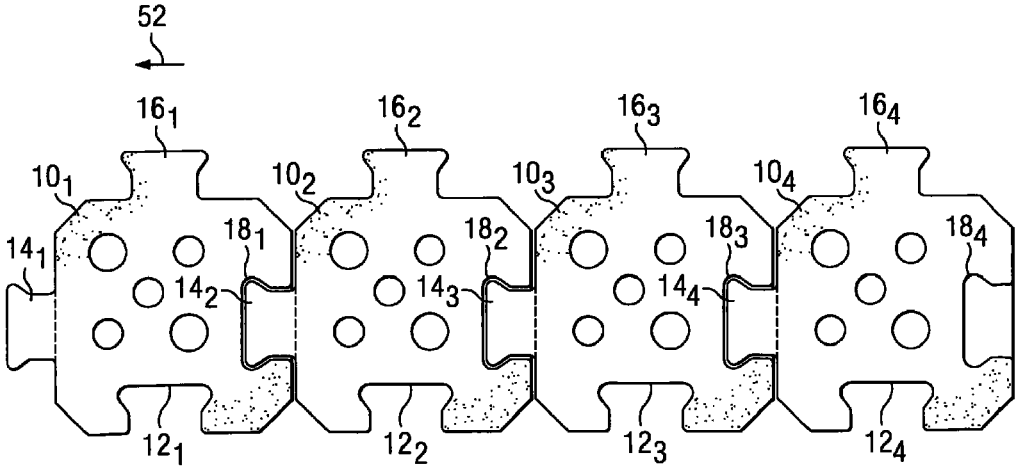
FIG. 7 is a row of a mat of revetment blocks installed according to the invention.

The partial thickness arm 14 of one block 10 can be lowered into the partial depth socket 18 of a neighbor block so that the neighbor block is vertically interlocked to the block 10. A row of four erosion control blocks $\mathbf{10}_1$-$\mathbf{10}_4$ are illustrated in FIG. 7. Additional blocks can be added to the row to form a mat of blocks and guard against erosion of the underlying ground when the water is flowing in the direction of arrow 52. The blocks are installed in the following manner. The down-stream most block 10, is first installed on the ground or on a geotextile material with the partial thickness arm $\mathbf{14}_1$ oriented downstream. Then the next block 10, is installed by lowering it over the block $\mathbf{10}_1$, with the partial thickness arm 14, lowered into the partial depth socket $\mathbf{18}_1$ of block $\mathbf{10}_1$. The next block $\mathbf{10}_3$ is then installed by lowering it so that the partial thickness arm $\mathbf{14}_3$ is lowered into the partial depth socket $\mathbf{18}_2$ of block $\mathbf{10}_2$. The next block $\mathbf{10}_4$ to be installed in the row is installed by lowering the partial thickness arm $\mathbf{14}_4$ thereof into the partial depth socket $\mathbf{18}_3$ of block $\mathbf{10}_3$. Other upstream blocks can be installed in a similar manner. In addition, another row of blocks can be installed by carrying out the same steps noted above, but in addition to lowering of a partial thickness arm of the block into the partial depth socket of the downstream block, the full thickness arm or the full depth socket of the block being installed is also lowered into the respective full depth socket or over the full thickness arm of the neighbor block in the other row.

Much like the conventional revetment block described in U.S. Pat. No. 5,556,228, the erosion control block 10 includes angled corners 54-60 to define an octagonal-shaped revetment block 10. With the angled corners 54-60, a square opening is formed at the location where the angled corners of four blocks meet, and the four blocks form a square.

Figure 8:
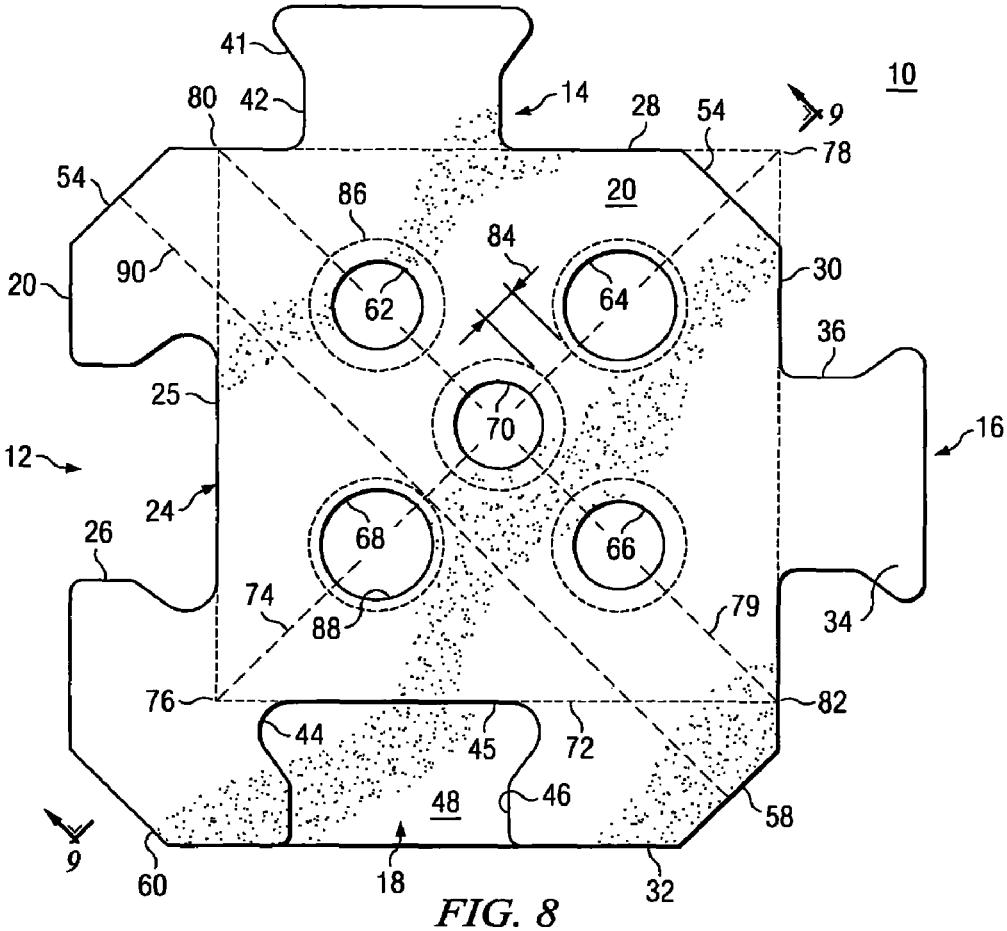
FIG. 8 is a top view of the erosion control block illustrating the details of the placement of the vegetation and gripping holes formed therein.

In accordance with an important feature of the invention, the erosion control block 10 is formed with plural, small holes through the block 10 to allow vegetation growth therethrough. As noted above, the growth of vegetation helps anchor the block 10 to the ground and thus the block 10 can withstand substantially more hydraulic lifting forces before being carried away by the water. According to an aspect of the invention, the holes are sized and located to assist an installer in lifting the block 10 and carrying the same with one hand. FIG. 8 illustrates the top view of the block 10 with five vegetation holes formed therein. The five holes include four holes 62-68 formed at the corners of a square 72 defining the core of the block 10. A fifth hole 70 is formed in the center of the other four holes 62-68. The five holes 62-70 are thus positioned like the five dots on a dice.

The five holes 62-70 are placed in the block at desired locations to accomplish various advantages. The holes 62-70 are located within a square identified by the broken line 72. As noted above, the square defined by the broken line 72 is the core of the block 10. The broken line 72 is that portion of the block that excludes the two arms 14 and 16 and the two sockets 12 and 18. Two adjacent sides of the core square 72 are coincident with two respective adjacent side edges 28 and 30 of the block 10, and two other adjacent sides of the core square 72 are coincident with the inner edges 25 and 45 of the enlarged cavities 24 and 44 of the respective sockets 12 and 18. The three holes 64, 70 and 68 are centered on a diagonal axis 74 which extends through the opposite corners 76 and 78 of the square core 72. The center hole 70 is located in the center of the core square 72. The respective centers of the holes 64 and 68 are equidistantly spaced from the center of the hole 70. In like manner, the three holes 62, 70 and 66 are centered on the other diagonal axis 79 which extends through the opposite corners 80 and 82 of the core square 72. Each hole is tapered so that the opening in the top 20 of the block is smaller than the corresponding opening at the bottom 22 of the block 10.

In the preferred embodiment of the erosion control block 10, the dimension of each side of the core square is 12.082 inches. The size of the opening of each hole 62-70 in the bottom 22 of the block, for example the bottom opening 86 of hole 62, is 3.0 inches. The spacing 84 between the bottom opening 86 of each hole 62-70 is 1.0 inch. Importantly, the diameter of the opening of each hole 62-70 in the top 20 of the block 10 is not the same. The holes 62, 70 and 66 have top openings all with a diameter of 2.0 inches. In contrast, the holes 64 and 68 have top openings 88 each with a diameter of 2.5 inches. Thus, the holes 64 and 68 have larger openings in the top 20 of the block 10 than the other holes. The effective open area at the bottom 22 of the block 10 is about 35.3 square inches.

In accordance with an important feature of the invention, the holes 64 and 68 located adjacent the opposite corners 78 and 76 of the core square 72 have larger openings in the top 20 of the block 10 to facilitate grasping by the fingers of a workman to lift the block and carry the same. More particularly, three fingers of a workman's hand, even with gloves, can be inserted into the 2.5 inch diameter top opening of the hole 64, with the thumb on the angled corner 54 and easily pick up the block 10. Alternatively, the workman can insert the fingers of a hand into the other 2.5 inch diameter opening of the hole 68, with the thumb in either the socket 12 or socket 18, and similarly lift the block. The distance between the edge of the hole 64 and the angled corner 54 is suitable to accommodate a person's hand. Similarly, the distance between the hole 68 and either of the sockets 12 or 18 can also easily accommodate a person's hand to firmly grasp and lift the block. Moreover, the taper of the holes 64 and 68 facilitates the maintenance of the grasp of the block 10 without it slipping. A block 10 can thus be carried in each hand of the workman.

According to another aspect of the invention, the holes 62-70 are dimensioned to provide a superior hydraulic stability to the block 10 under severe water flow conditions, and also to allow vegetation to grow therethrough to enhance anchoring of the block 10 to the ground. It is recognized that for best hydraulic performance, there would be no holes in the block, as the downstream edge of each hole allows the water flow to exert a force thereon in a direction tending to lift the block 10. However, it is also known that the hydrostatic force on an erosion control block can be relieved with one or more holes formed therethrough. Thus, the concern is how many holes should be formed in an erosion control block, and the size thereof, to achieve optimum hydraulic stability, allow the block to relieve hydrostatic pressure, allow easy grasping thereof using the holes, and the placement of the holes to maintain the strength and integrity of the block.

As noted above the holes 62-70 are tapered so that the larger-size opening is at the bottom 22 of the block 10 to increase the area exposed to the ground to promote vegetation growth therein. The size of each opening of the block 10 at the top 20 is critical to the hydraulic stability of the block. In the preferred embodiment, the average diameter of each hole at the top 20 of the block 10 is ideally attempted to be about half the thickness of the block, namely 2.125 inch diameter for the 4.25 inch thick block 10. It is realized that it is the top openings of the holes 62-70 that are subjected to the force of the water flowing over the block 10. However, with two holes 64 and 68 having larger diameters (2.5 inches) than the ideal to accommodate the insertion of fingers therein, the other three holes 62, 70 and 66 are constructed with slightly smaller openings (2.0 inches) than the ideal. With this construction, it is anticipated that the erosion control block 10 will exhibit superior hydraulic stability and thus remain stable in an interlocked mat when subjected to high velocity water flowing thereover. As noted above, by employing five holes complying with the foregoing criterion, the desired area of vegetation growth in each hole is maximized, without compromising the hydraulic stability of the block 10. The physical strength and integrity of the block 10 is also maintained. Stated another way, the holes 62-70 are spaced in the core square 72 away from the block edges and the cavities so that the block 10 is not weakened at various areas due to the holes 62-70. Nevertheless, the various holes 64 and 68 are placed sufficiently close to the edge of either the block or a socket so as to allow easy grasping by a person's hand.

While the preferred embodiment of the invention employs five holes to achieve a desired vegetation growth area, other numbers of holes can be utilized. If a smaller vegetation area is desired than the four holes 62, 64, 66 and 68 can be used. If three holes are desired, then either the three holes 62, 70 and 66 can be used, or the holes 64, 70 and 68 can be used. If two holes are desired, then two of the holes can be used and located in the core square 72. Preferably, the diameter of the holes, irrespective of the number thereof, should not be larger than about half the thickness of the block, if the optimum hydraulic stability is to be maintained.

While not shown, the block 10 can be formed with cable channels therethrough to allow a number of the block 10 to be cabled together, in an interlocked arrangement, and installed on an embankment or other watershed area. One diagonal cable channel can be formed through the block 10 with a bore axially aligned with the diagonal line 74 so as to extend between opposite angled corners 54 and 60 of the block 10. This diagonal cable channel would extend through the three holes 64, 70 and 68. The second diagonal cable channel would have a bore aligned with the line 90 and would pass through the block 10 between the three aligned holes 62, 70 and 66, and the other hole 68 so as not to intersect with any of the holes in the block 10. The second cable channel would extend between the diagonal corners 54 and 58.

Figure 9:
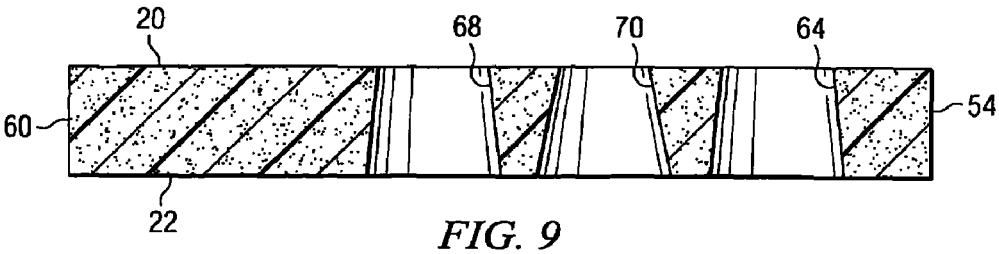
FIG. 9 is a cross-sectional view of the revetment block, taken along line 9-9 of FIG. 8.

FIG. 9 is a cross-sectional view taken along the diagonal line 74, illustrating the details of the holes 68, 70 and 64. Each hole 68, 70 and 64 is tapered so as to flare out toward the bottom 22 of the block 10. The bottom diameter of each hole 68, 70 and 64 is the same, but the top diameters are not the same. The diameter of the top openings of the outer holes 64 and 68 is the same, but is larger than the diameter of the top opening of the center hole 70. As noted above, the larger-diameter holes 64 and 68 allow a workman to better insert multiple fingers, preferably three fingers, therein to grasp the block 10.

While the foregoing illustrates an erosion control block employing interlocking arms and sockets, together with multiple holes therethrough, the various features of the invention can be employed separately. To that end, a block such as disclosed in U.S. Pat. No. 5,556,228 can be constructed with multiple holes to achieve a greater degree of hydraulic stability without sacrificing the area through which vegetation can grow to further anchor the block to the underlying ground. In addition, the features of the invention can be utilized in erosion control blocks of dimensions, shapes and sizes other than that described above.

While the preferred and other embodiments of the invention have been disclosed with reference to specific revetment blocks, and associated methods of construction and installation thereof, it is to be understood that many changes in detail may be made as a matter of engineering choices without departing from the spirit and scope of the invention, as defined by the appended claims.

What is claimed is:

1. A revetment block, comprising:

said block having a body with a thickness defined by a distance between a top surface and a bottom surface of the body of said block, and said block having a plurality of side edges;

at least two arms, each arm extending from a respective side edge of the body of said block;

each said arm having an enlarged end connected to a respective side edge by a narrowed neck portion;

at least two sockets formed inwardly from respective side edges of the body of said block;

each said socket having an enlarged cavity connected by a narrowed inlet to the respective side edge of the body of said block, each said socket adapted for receiving therein an arm of a similarly constructed neighbor block; and a plurality of holes formed through the body of said block, wherein said holes are each tapered to flare out from the top surface of said block to the bottom surface of said block, a diameter of a bottom opening of each said hole in the bottom surface of said block is the same, and a diameter of a top opening of each said hole in the top surface of said block are not all the same.

2. The revetment block of claim 1, wherein said plurality of holes includes five holes.

3. The revetment block of claim 2, wherein said five holes are located in the block in the manner of dots of a five-dot side of a dice.

4. The revetment block of claim 2, wherein said five holes are formed in said block in a core square, said core square having a first and second diagonals, each said diagonal extending from respective opposite corners of said core square, said core square having a portion of a first side coincident with the first side edge of said block, a portion of a second side of said core square coincident with the second side edge of said block, a portion of a third side of said core square coincident with the inner side edge of said first socket, and a portion of a fourth side of said core square coincident with the inner edge of said second socket; and the first said diagonal of said core square extending through two said holes, the second said diagonal of said core square extending through two other said holes, and an intersection of said first and second diagonals of said core square located at a fifth said hole.

5. The revetment block of claim 1, wherein two said holes have larger diameter openings in the top surface of said block than the other three said holes.

6. The revetment block of claim 1, wherein a finger hole is located adjacent two said sockets so that a workman can grasp the block between the finger hole and one said socket.

7. The revetment block of claim 1, wherein said block is octagonal shaped, including four said side edges, and four angled corners, and wherein a finger hole is located adjacent an angled corner located between two said arms.

8. The revetment block of claim 1, wherein said holes are formed in a core square of said block where said core square includes a square area that excludes the arms and the sockets of said block, two adjacent sides of the core square are coincident with a portion of two respective adjacent side edges of said block, and respective portions of two adjacent sides of the core square are coincident with inner edges of the enlarged socket cavities.

9. A revetment block, comprising:

a block having a body with a thickness defined by a distance between a top surface and a bottom surface of the body of said block, and said block having a plurality of side edges;

a first and second arm, each said arm extending from a respective first and second side edge of the body of said block, at least one said arm having a full thickness that extends from the top surface of said block to the bottom surface of said block;

a first and second socket, each said socket formed inwardly from a respective third and fourth side edges of the body of said block, and each said socket having a respective inner side edge, at least one said socket having a full depth that extends for from the top surface of said block to the bottom surface of said block;

a core square having a first diagonal and a second diagonal, said first and second diagonal extending from respective opposite corners of said core square, said core square having a portion of a first side coincident with the first side edge of said block, a portion of a second side of said core square coincident with the second side edge of said block, a portion of a third side of said core square coincident with the inner side edge of said first socket, and a portion of a fourth side of said core square coincident with the inner edge of said second socket; and five holes formed through the body of said block in said core square, the first said diagonal of said core square extending through two of said five said holes, the second said diagonal of said core square extending through two other of said five holes, and an intersection of said first and second diagonals of said core square located within a fifth hole of said five hole; and wherein a diameter of respective openings of all five said holes on one of the top or bottom surface of said block is the same, and wherein a diameter of respective openings of three of said five holes on the other of the top or bottom surface of said block is different from the diameter of the openings of the other two holes of said five holes on the other of the top or bottom surface of said block.

10. The revetment block of claim 9, wherein said five holes are located in the block in the manner of dots of a five-dot side of a dice.

11. The revetment block of claim 9, wherein said two arms are located on respective adjacent sides of said block, a corner of said revetment block located between said two arms includes a surface that is angled, and one said hole having a larger diameter opening than the other said three holes is located adjacent to the angled corner so that an installer can grasp the block using three fingers in the larger-diameter hole.

12. The revetment block of claim 9, wherein the top surface of said block includes a respective top surface opening for each of said five holes, two of the top surface hole openings having the same diameter, said same diameter being larger than a diameter of the other three top surface openings, and said two top surface openings of are located on a common said diagonal of said core square.

* * * * *